US005268715A

United States Patent [19]

Hirano

[11] Patent Number: 5,268,715

[45] Date of Patent: Dec. 7, 1993

[54] PHOTOCONDUCTIVE DRUM EXPOSURE PREVENTION STRUCTURE IN A CLAMSHELL-TYPE IMAGE FORMING APPARATUS

[75] Inventor: Masakazu Hirano, Tokyo, Japan

[73] Assignee: Asahi Kogaku Kogyo Kabushiki Kaisha, Tokyo, Japan

[21] Appl. No.: 683,545

[22] Filed: Apr. 10, 1991

[30] Foreign Application Priority Data

Apr. 10, 1990 [JP] Japan ..... 2-94419

[51] Int. Cl.[5] ..... G03G 21/00

[52] U.S. Cl. ..... 355/215; 355/211; 355/221

[58] Field of Search ..... 355/211, 221, 215, 312, 355/200, 210, 219, 274; 250/324, 325, 326

[56] References Cited

U.S. PATENT DOCUMENTS

| | | | |
|---|---|---|---|
| 3,777,158 | 12/1973 | Kamogawa et al. | 250/324 |
| 4,021,709 | 5/1977 | Kamogawa et al. | 250/326 X |
| 4,334,761 | 6/1982 | Saito et al. | 355/232 |
| 4,540,268 | 9/1985 | Toyono et al. | 355/210 |
| 4,566,777 | 1/1986 | Honda et al. | 355/219 X |
| 4,607,941 | 8/1986 | Honda | 355/221 X |
| 4,757,342 | 7/1988 | Ogura et al. | 355/211 X |
| 4,851,865 | 7/1989 | Ehara et al. | 346/160.1 |
| 4,941,015 | 7/1990 | Komai et al. | 355/215 X |

FOREIGN PATENT DOCUMENTS

| | | | |
|---|---|---|---|
| 3330262 | 12/1988 | Fed. Rep. of Germany . | |
| 0078466 | 5/1985 | Japan | 355/215 |
| 0075658 | 4/1987 | Japan | 355/215 |
| 0153965 | 7/1987 | Japan | 355/215 |
| 0283357 | 12/1987 | Japan | 355/221 |
| 0265258 | 11/1988 | Japan | 355/221 |
| 1418180 | 12/1975 | United Kingdom . | |
| 1541322 | 2/1979 | United Kingdom . | |
| 2193159 | 2/1988 | United Kingdom . | |

*Primary Examiner*—A. T. Grimley
*Assistant Examiner*—Robert Beatty
*Attorney, Agent, or Firm*—Sandler, Greenblum & Bernstein

[57] ABSTRACT

A charging station structure of a clamshell-type electrophotographic image forming apparatus which has a photoconductive member is provided with a corona charger for uniformly charging the photoconductive member. An opening is defined on an upper surface of the corona charger for letting ozone escape, and a roof member is arranged at a position opposite to the photoconductive member, with respect to the opening, for covering the opening. A predetermined interval is provided between the upper surface of the corona charger and the roof member, so that ambient light incident upon the photoconductive member though the opening is prevented, while nonetheless allowing ozone to escape from the corona charger.

7 Claims, 3 Drawing Sheets

PHOTOCONDUCTIVE DRUM EXPOSURE PREVENTION STRUCTURE IN A CLAMSHELL-TYPE IMAGE FORMING APPARATUS

BACKGROUND OF THE INVENTION

The present invention relates to an improvement of a charging unit of an electrophotographic image forming apparatus, having a swingably openable clamshell.

Laser beam printers are known in which, an electrostatic latent image is formed by scanning and exposing a uniformly charged photoconductive material arranged on a photoconductive drum by a laser beam modulated in accordance with image data, such as figures, characters and the like, in order to obtain a hard copy of the image data through an electrophotographic image forming process, comprising the steps of developing, transferring, and fixing.

In a laser beam printer, an electrostatic photoconductive material is provided on the circumferential surface of a photoconductive drum. Around the photoconductive drum, a charging unit, exposing unit, developing unit, transferring unit, cleaner unit, and discharging unit are disposed, as viewed in the direction of rotation of the photoconductive drum.

The photoconductive material on the surface of the photoconductive drum, which is uniformly charged by the charging unit, is exposed by a laser beam carrying image data, at the exposing unit, in order to form a latent image on the photoconductive material. Toner is then stuck to the latent image by the developing unit for development (forming a toner image), and the toner image is transferred onto a recording sheet, which is fed at the same speed as the peripheral speed of the photoconductive drum at the transferring unit. The toner image transferred onto the recording paper is then heated or pressed by the fixing unit, and, thus, the toner image is fixed onto the recording sheet. Then the recording sheet, carrying the fixed image thereon, is ejected from the printer.

Generally, the transferring unit is disposed below the photoconductive drum, and the charging unit and a scanning optical system, forming the exposing unit, are disposed above the photoconductive drum.

The photoconductive drum must be replaced at a predetermined operation time, depending on the life of the photoconductive material thereof. Generally, the photoconductive drum is integrally arranged as a drum unit with the cleaner, charging unit (i.e., the corona charger) and the like having a predetermined positional relationship with respect to the photoconductive drum.

Further, in the laser beam printer as described above, a clamshell is arranged to be swingably opened to carry out maintenance, and to load a recording sheet when a continuous recording sheet is used.

The charging unit is provided with a corona charge comprising a thin metal wire of tungsten or the like interposed between oppositely disposed electrode plates extending in the axial direction of the photoconductive drum, and the photoconductive material provided on the photoconductive drum is uniformly charged with the corona charger.

When the corona charger discharges, ozone is produced, and the ozone should be allowed to escape therefrom. One method for causing the ozone to escape from the corona charger is a method in which the upper side of the corona charger is opened in order to enable ozone produced by the corona charger to escape therefrom.

When the clamshell is swingably opened, a problem arises in that, because the upper portion of the corona charger of the charging unit should be opened, the photoconductive drum is exposed to ambient light through the opening which is formed on the upper side of the corona charger. Since the photoconductive material on the surface of the photoconductive drum is deteriorated by being exposed to light, the life of the drum is shortened.

SUMMARY OF THE INVENTION

It is therefore an object of the present invention to provide a photoconductive drum exposure prevention structure by which a photoconductive drum is prevented from being exposed to ambient light through the opening formed at an upper portion of the corona charger, when an upper portion constituting member is opened, and, thereby, the photoconductive material on the surface of the photoconductive drum is prevented from being deteriorated.

For the above objects, according to the present invention, a charging station structure of an electrophotographic image forming apparatus which has a photoconductive member is provided, the charging station, comprising:

a corona charger for uniformly charging the photoconductive member, an opening being defined on the upper surface of the corona charger for letting ozone escape therefrom; and shade means for preventing ambient light incident upon the photoconductive, member, while nonetheless allowing ozone to escape, said shading means being arranged at a position opposite to the photoconductive member with respect to the opening which is defined on the upper surface of the corona charger, whereby ambient light incident upon the photoconductive member through the opening is prevented.

Optionally, the shade means comprises at least one roof member arranged such that the surface of the roof member is substantially parallel to a plane of the opening formed on the upper surface of the corona charger, and a pair of support members, one end portion of each of support members being engaged with the upper surface of the corona charger where the portions contact lateral ends of the opening formed on the upper surface, respectively, the other end portions of the support members being secured to the roof member.

Further, the roof member is composed of an elastic material. Accordingly, cleaning of the charger wire can be carried out without removing the roof member.

According to another aspect of the invention, an electrophotographic image forming apparatus is provided comprising a main body, a clamshell, and a photoconductive member, the apparatus further comprising:

a corona charger for uniformly charging the photoconductive member, an opening being defined on the upper surface of the corona charger for letting ozone escape therefrom; and shade means for preventing ambient light to be incident upon the photoconductive member, while nonetheless allowing ozone to escape, said shade means being arranged at a position opposite to the photoconductive member with respect to the opening which is defined on the upper surface of the corona charger, whereby ambient light incident upon the photoconductive member, through the opening, is prevented even if the clamshell is opened.

Further, the shade means comprises at least one roof member arranged such that the surface of the roof member is substantially parallel to a plane of the opening formed on the upper surface of the corona charger, and a pair of support members, one end portion of each of the support members being engaged with the upper surface of the corona charger where the portions contact lateral ends of the opening formed on the upper surface, respectively, the other end portions of the support members being secured to the roof member.

Still further, the clamshell is pivoted about an axis provided on the main body, wherein the corona charger has a frame member located at the swingable side of the clamshell, the frame member extending upwardly so as to contact one end of the roof member, whereby a gap for letting ozone escape is formed between the roof member and the corona charger only at the pivoted side of the clamshell.

Furthermore, the roof member comprises an elastic material.

DESCRIPTION OF THE ACCOMPANYING DRAWINGS

DESCRIPTION OF THE EMBODIMENTS

Figure 1:
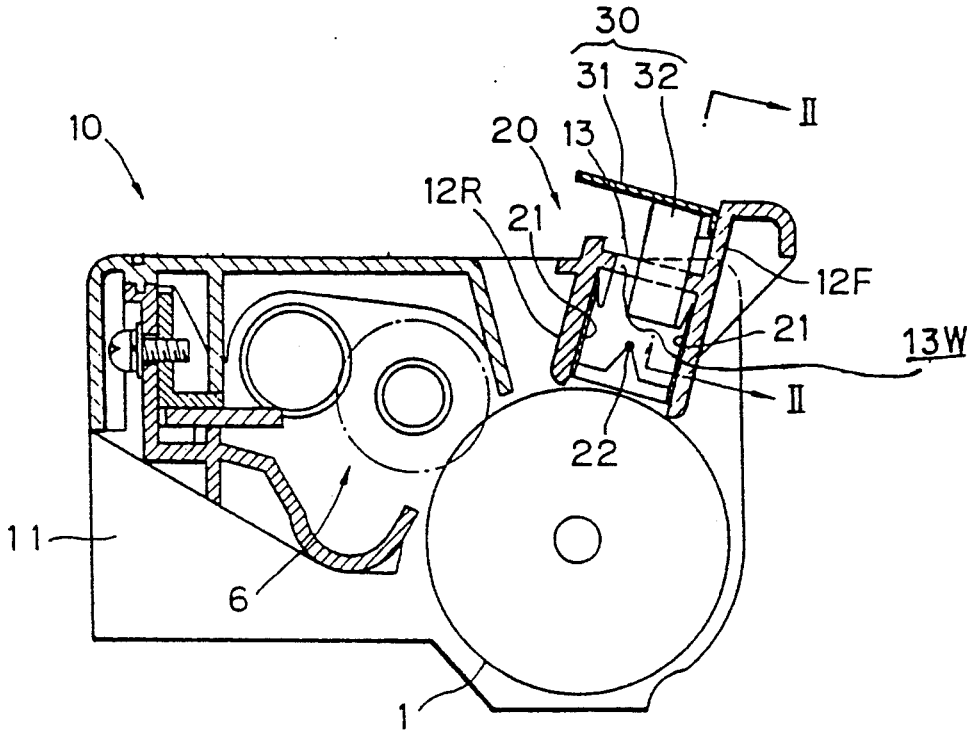
FIG. 1 is a lateral cross-sectional view of a drum unit employing a photoconductive drum exposure prevention structure embodying the present invention.

FIG. 1 is a cross-sectional view of a drum unit 10 employing a photoconductive drum exposure prevention structure embodying the present invention.

In the drum unit 10 of FIG. 1, a photoconductive drum 1, corona charger 20 and cleaner 6 are integrally arranged within a modular plastic unit frame 11.

The corona charger 20 is arranged in such a manner that two plate-shaped charger frames 12F, 12R are oppositely disposed, substantially above the photoconductive drum 1 in the axial direction of the frames, by a predetermined interval. Electrode plates 21, 21 are placed on the confronting inside surfaces of the two charger frames 12F, 12R, respectively, and a wire 22 is stretched at the center thereof in the axial direction of the photoconductive drum 1.

The charger frames 12F, 12R are connected to each other at opposite ends thereof by a ceiling 13, and an opening 13W extending in the axial direction of the photoconductive drum 1 is formed on the ceiling.

Edge portions 13A, 13A are vertically formed on respective ends of; the ceiling 13 defining the lateral ends of the opening 13W. A shade member 30 is provided with structure to detachably mate with the ceiling edge portions 13A, 13A.

Figure 4:
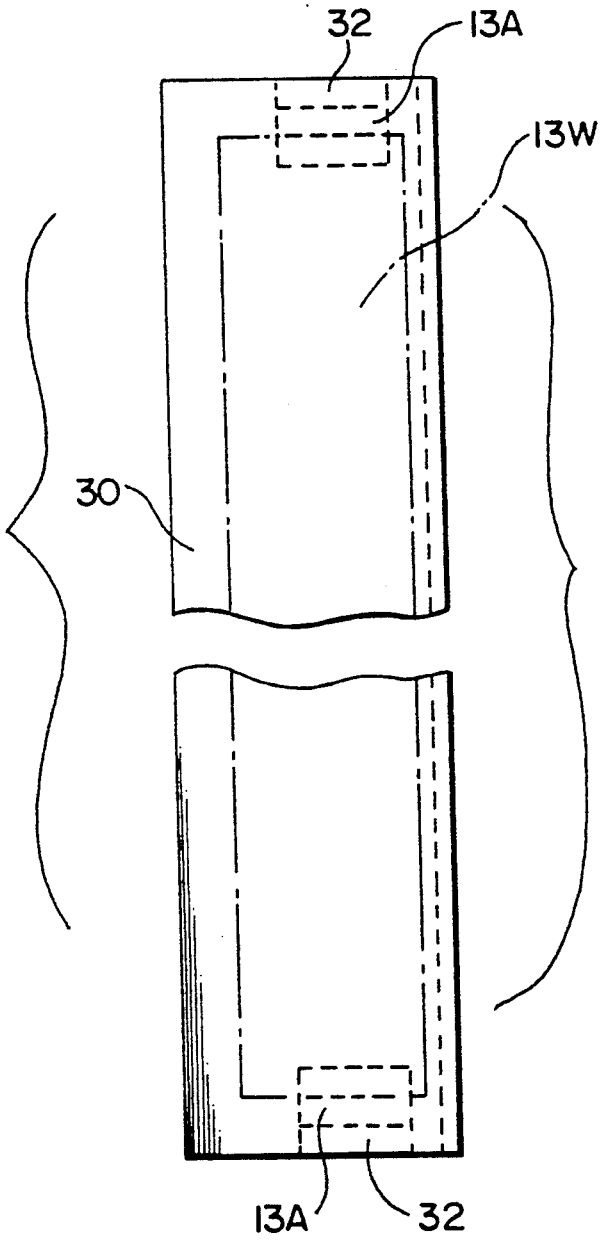
FIG. 4 is a top view of a shading member of the drum exposure prevention structure embodying the present invention.

FIG. 4 is a top view of a shading member 30 of the photoconductive drum exposure prevention structure. The shade member 30 comprises a thin shade plate 31 having engaging members 32, 32 fixed to opposite ends of the thin shade plate. The engaging members 32, 32 engage with edge portions 13A, 13A, respectively. Thereby, shade plate 31 is arranged above the opening 13W.

The shade plate 31 has a width greater than that of the opening 13W of the corona charger 20, with the end of the shade plate abutting against the charger frame 12F, on the right side in FIG. 1, being bent downwardly by a predetermined width, and then being secured to charger frame 12F.

Figure 2:
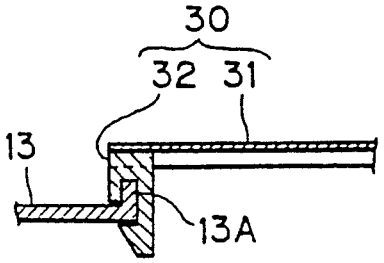
FIG. 2 is a cross-sectional view thereof taken along the line II—II of FIG. 1.

An engaging space is defined on each engaging member 32, and thus each edge portion 13A of the ceiling 13 is fitted therein so that it will not be removed therefrom, as shown in FIG. 2, which is a cross-sectional view of FIG. 1 taken along line II—II. Further, the shade plate 31 is positioned in such a manner that there is a predetermined spacing between plate 31 and the upper end of the charge frame 12R on the left side, as shown in FIG. 1, when engaging portions 32, 32 engaged with the edge portions 13A, 13A, respectively.

Figure 3:
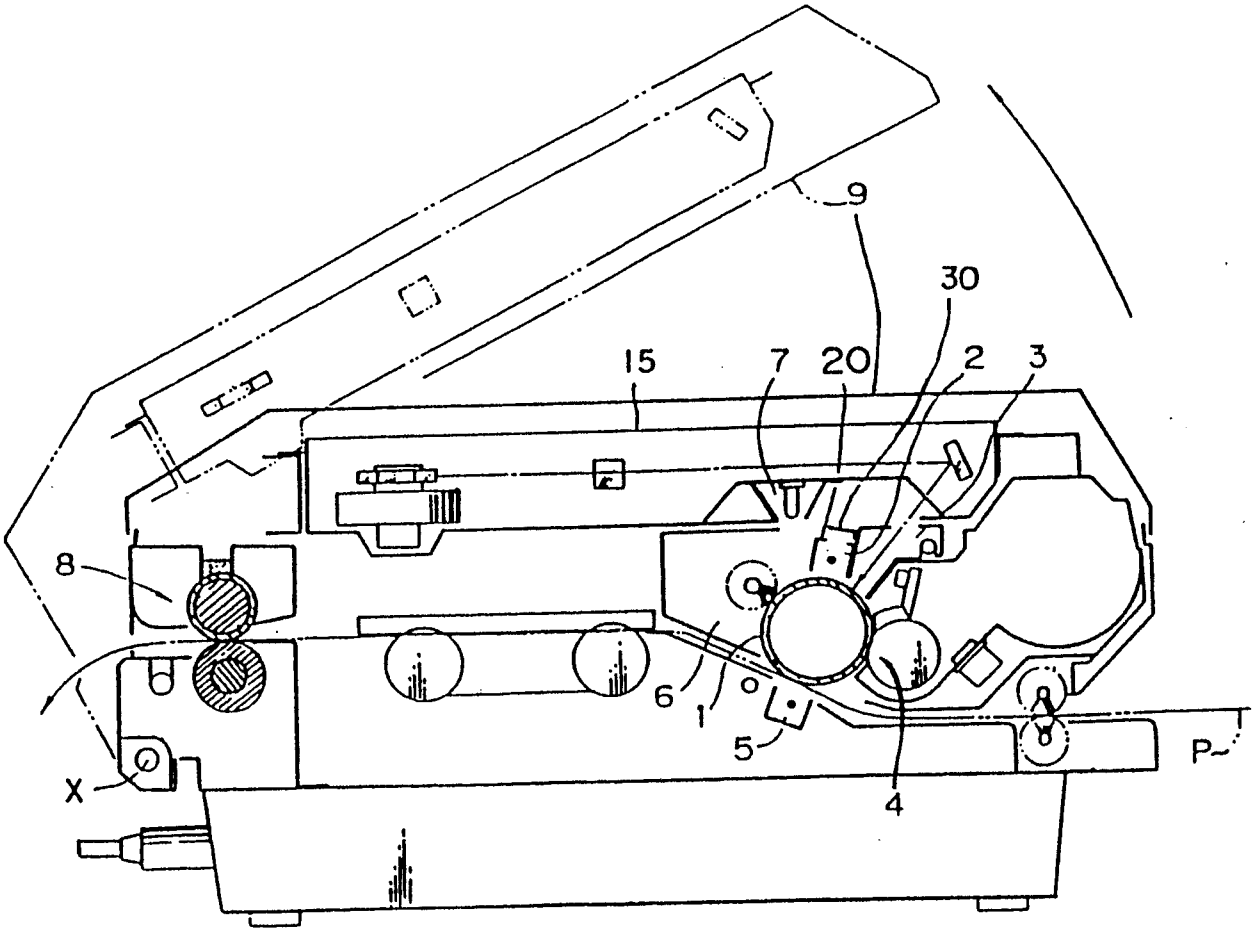
FIG. 3 is an example of a schematic side view of a laser beam printer provided with the exposure prevention structure embodying the present invention.

FIG. 3 is an example of a schematic side view of a laser beam printer provided with the exposure prevention structure embodying the present invention. In this printer, around a photoconductive drum 1 having a surface which comprises an electrostatic photoconductive material, are located a charging unit 2, an exposing unit 3, a developing unit 4, a transferring unit 5, cleaner unit 6, and discharging unit 7, listed in the order that they are disposed, in the rotational direction, about the photoconductive drum 1.

The photoconductive material on the surface of the photoconductive drum 1, which is uniformly charged by the charging unit 2, is exposed by a laser beam carrying image data at the exposing unit 3 to form a latent image on the photoconductive material. Toner is then stuck to the latent image by the developing unit 4 for development (forming a toner image), and the toner image is then transferred onto a recording sheep P. The toner image transferred onto the recording paper P is heated or pressed by the fixing unit 8, and the toner image is thus fixed onto the recording sheet P, with the recording sheet and the fixed image then being ejected from the printer.

In FIG. 3, the transferring unit 5 is disposed below the photoconductive drum 1, a recording sheet feed path is defined in the substantially horizontal direction on the right and left sides of the transferring unit 5, and the charging unit 2 and scanning optical system 15, as is the exposing unit 3, are disposed above the photoconductive drum 1.

The charging unit 2 is provided with a corona charger 20 comprising a thin metal wire of tungsten or the like interposed between oppositely disposed electrode plates, and the photoconductive material provided on the photoconductive drum 1 is uniformly charged by the corona charger 20. The upper side of the corona charger 20 must be opened to enable ozone produced by the corona discharge to escape therefrom.

In the laser beam printer of FIG. 3, a clamshell 9, including the scanning optical system 15, is arranged to be swingably opened about a fulcrum X arranged at the lower portion of the rear end (paper discharge side) of the printer. When the shade member 30 is mounted on the ceiling 13, the right end of the shade plate 31 abuts against the charge frame 12F on the right side without leaving a gap therebetween, and the left end of the shade plate 31 on the fulcrum side of the clamshell 9 forms an opening, in a vertical direction, having a substantially predetermined width with respect to the upper surface of the charger frame 12R on the left side in FIG. 1. More specifically, the upper side of the corona charger 20 is opened between the charger frames 12R on the fulcrum side and the shade member 30.

With the above arrangement, even if the upper member is opened to load continuous paper or effect maintenance, the photoconductive drum 1 is not exposed to ambient light through the opening formed on the upper portion of the corona charger 20, and, further, because the photoconductive drum 1 is located in the shade of the upper portion constituting member, it is prevented from being directly exposed to light, and thus the photoconductive material is prevented from being deteriorated by being exposed to the ambient light. Furthermore, since the shade plate 31 of the shade member 30 is composed of an elastic member, as described above, cleaning of the wire 22 of the corona charger 20 can be easily carried out.

Note, in the above embodiment, although the single shade plate 31 is provided to open the fulcrum side of the corona charger 20, another shade plate may be provided to contact the shade plate 31, wherein light can be more securely shaded.

As described above, according to the photoconductive drum exposure prevention structure of the present invention, since the photoconductive drum is not exposed to ambient light through the corona charger even if the upper portion opening member is opened, the photoconductive member on the surface of the photoconductive drum is prevented from being deteriorated by being exposed to the ambient light.

What is claimed is:

1. A clamshell-type electrophotographic image forming apparatus comprising a main body, a clamshell, and a photoconductive member, said apparatus further comprising:

a corona charger for uniformly charging said photoconductive member, said corona charger having an upper surface and an opening defined in the upper surface of said corona charger for allowing ozone to escape from said charger; and shade means for preventing ambient light from being incident upon said photoconductive member while allowing ozone to escape, said shade means being arranged at a position opposite from said opening in the upper surface of said corona charger, whereby ambient light will be prevented from being incident upon said photoconductive member even if said clamshell is opened, wherein said shade means overlies substantially only said opening and is located over said opening in relation to the direction of light entering from outside the main body of said image forming apparatus when the clamshell is opened, thus forming a resulting opening positioned to prevent ambient light from reaching said photoconductive member, wherein said resulting opening is located at a side of said corona charger which is closest to a pivot axis of the clamshell.

2. The image forming apparatus according to claim 1, wherein said shade means comprises:

at least one roof member positioned in a substantially parallel fashion to a plane in which said opening is located; and a pair of support members, each having two end portions, for supporting said at least one roof member, one end portion of each of said support members being engaged with said upper surface of said corona charger, at opposed ends of said opening formed on said upper surface, respectively, the other end portion of each of said support members being secured to said roof member.

3. The electrophotographic image forming apparatus according to claim 2, wherein said clamshell is pivotable about said axis, said axis provided on said main body, said clamshell comprising a pivoted side adjacent said axis and a pivot side opposite said pivoted side, wherein said corona charger includes one frame member located nearer said pivot side of said clamshell, said frame member extending upwardly so as to contact one end of said roof member, and a gap for letting ozone escape is formed between said roof member and said corona charger only at the pivoted side of said clamshell.

4. The electrophotographic image forming apparatus according to claim 3, wherein said roof member comprises an elastic material.

5. The charging station of claim 1, wherein said shade means is supported by said upper surface of said corona charger.

6. A clamshell-type electrophotographic image forming apparatus comprising a main body, a clamshell, and a photoconductive member, said clamshell forming an opening at a first side of said image forming apparatus main body and pivoting at a second side of said image forming apparatus, which is opposite said first side, said apparatus comprising:

a corona charger for uniformly charging said photoconductive member, said corona charger having a first side portion and a second side portion, said first side portion being between said first side of said apparatus and said second side portion of said charger, said corona charger further having an upper portion and an opening defined between said upper portion and said second side portion for allowing ozone to escape from said corona charger, said opening being positioned to prevent ambient light from reaching said photoconductive member; and shade means for preventing ambient light, coming from outside of said main body, from being incident onto said photoconductive member, while still allowing ozone to escape, said shade means comprising a member which extends from said first side portion of said charger to said opening.

7. The image forming apparatus according to claim 6, wherein said member comprises a first end connected to said first side portion of said charger and a second end which extends to said opening and overhangs said second side portion of said charger.

* * * * *